US005499623A

United States Patent [19]

Pasternack

[11] Patent Number: 5,499,623

[45] Date of Patent: Mar. 19, 1996

[54] GAS MASK AND BREATHING EQUIPMENT WITH LIQUEFIED RESPIRATION GAS

[75] Inventor: Adalbert Pasternack, Bad Schwartau, Germany

[73] Assignee: Dragerwerk AG, Lubeck, Germany

[21] Appl. No.: 1,264

[22] Filed: Jan. 7, 1993

[30] Foreign Application Priority Data

Feb. 22, 1992 [DE] Germany ..... 42 05 412.5

[51] Int. Cl.[6] ..... A62B 7/06; A62B 9/00; F17C 7/04; F17C 9/02

[52] U.S. Cl. ..... 128/201.21; 128/DIG. 27; 128/204.18; 128/205.22; 62/48.1; 220/901

[58] Field of Search ..... 128/201.21, 200.24, 128/202.27, 204.15, 204.18, 205.22, 913, DIG. 27; 62/48.1, 50.1, 50.2, 50.4; 220/901

[56] References Cited

U.S. PATENT DOCUMENTS

| | | | |
|---|---|---|---|
| 2,242,108 | 5/1941 | Bullowa et al. | 128/201.21 |
| 2,244,659 | 6/1941 | Bullowa et al. | 128/201.21 |
| 2,277,547 | 3/1942 | Hartman | 128/201.21 |
| 2,310,277 | 2/1943 | Bullowa et al. | 128/201.21 |
| 2,842,942 | 7/1958 | Johnston et al. | 62/48.1 |
| 2,990,695 | 7/1961 | Leffingwell, Jr. | 128/201.21 |
| 3,062,017 | 11/1962 | Balcar et al. | 128/DIG. 27 |
| 3,097,497 | 7/1963 | Fitt | 128/201.21 |
| 3,199,303 | 8/1965 | Haumann et al. | 128/DIG. 27 |
| 3,869,871 | 3/1975 | Rylalko et al. | 128/201.25 |
| 3,941,124 | 3/1976 | Rodewald et al. | 62/48.1 |
| 4,314,138 | 2/1982 | Itoh | 128/203.27 |
| 4,601,287 | 7/1986 | Royce, Jr. | 128/204.17 |

FOREIGN PATENT DOCUMENTS

| | | | |
|---|---|---|---|
| 467014 | 8/1950 | Canada | 128/201.21 |
| 0352938 | 1/1990 | European Pat. Off. | 128/205.25 |
| 488880 | 6/1992 | European Pat. Off. | 128/201.21 |
| 208841 | 6/1907 | Germany | 128/204.17 |
| 1214090 | 4/1966 | Germany | 128/204.17 |
| 544125 | 3/1942 | United Kingdom | 128/201.21 |
| 733473 | 7/1955 | United Kingdom | 128/201.21 |
| 751099 | 6/1956 | United Kingdom | 128/204.15 |
| 901334 | 7/1962 | United Kingdom | 128/201.21 |
| 1003647 | 9/1965 | United Kingdom | 128/201.21 |

*Primary Examiner*—Kimberly L. Asher
*Attorney, Agent, or Firm*—McGlew and Tuttle

[57] ABSTRACT

A gas mask and breathing equipment arrangement with a storage tank for liquefied respiration gas and an air circulation duct intended for transmitting heat of evaporation from the ambient air to the liquefied respiration gas. A sufficient flow rate of ambient air will be achieved under all conditions of use by providing a fan (22) for delivering ambient air through the air circulation duct (20).

5 Claims, 2 Drawing Sheets

GAS MASK AND BREATHING EQUIPMENT WITH LIQUEFIED RESPIRATION GAS

FIELD OF THE INVENTION

The present invention pertains to a gas mask and breathing equipment with a storage tank for liquefied respiration gas and an air circulation duct for transferring heat of evaporation from the ambient air to the liquefied respiration gas.

BACKGROUND OF THE INVENTION

Such a gas mask and breathing equipment is described in West German Patent No. DE-PS 20,88,41. In the prior-art device, the storage tank is surrounded by an air circulation duct on all sides, or the air circulation duct is designed in the form of tubes arranged within the storage tank. Ambient air, driven by natural convection, flows through the air circulation duct. A stopcock, by means of which the user is able to regulate the air flow and consequently the amount of respiration gas evaporated per unit of time, is provided at an air outlet arranged at the bottom.

It is disadvantageous in this prior-art gas mask and breathing equipment that the amount of air flowing as a result of convection is not sufficient, e.g., at low ambient temperatures, to deliver a sufficient amount of respiration gas, and that manual regulation requires too much attention on the part of the user.

SUMMARY AND OBJECT OF THE INVENTION

Therefore, it is an object of the present invention to provide a gas mask and breathing equipment of the above-described type, in which heat can be supplied for a container in a specific manner such that the amount of respiration gas generated can be maintained at a defined level.

This object is attained by providing a fan for delivering ambient air through the air circulation duct wherein the fan is regulated for regulating the ambient air flow via a particular sensor (volume rate of low sensor) whereby the quantity of liquid anesthetic fluid which is evaporated to a predetermined amount per unit time.

The advantage of the present invention is the fact that a sufficient air flow rate can be ensured under all circumstances by using a fan. Furthermore, the amount of respiration gas can be maintained at a constant value or adjusted to various predeterminable values by using a control unit, which controls the fan as a function of the amount of respiration gas to be produced, without the user having to interfere. All environmental effects, as well as the effects of the respiratory activity and the amount of supply available in the storage tank can be eliminated.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DETAILED DESCRIPTION OF THE PREFERRED EMBODIMENTS

Figure 1:
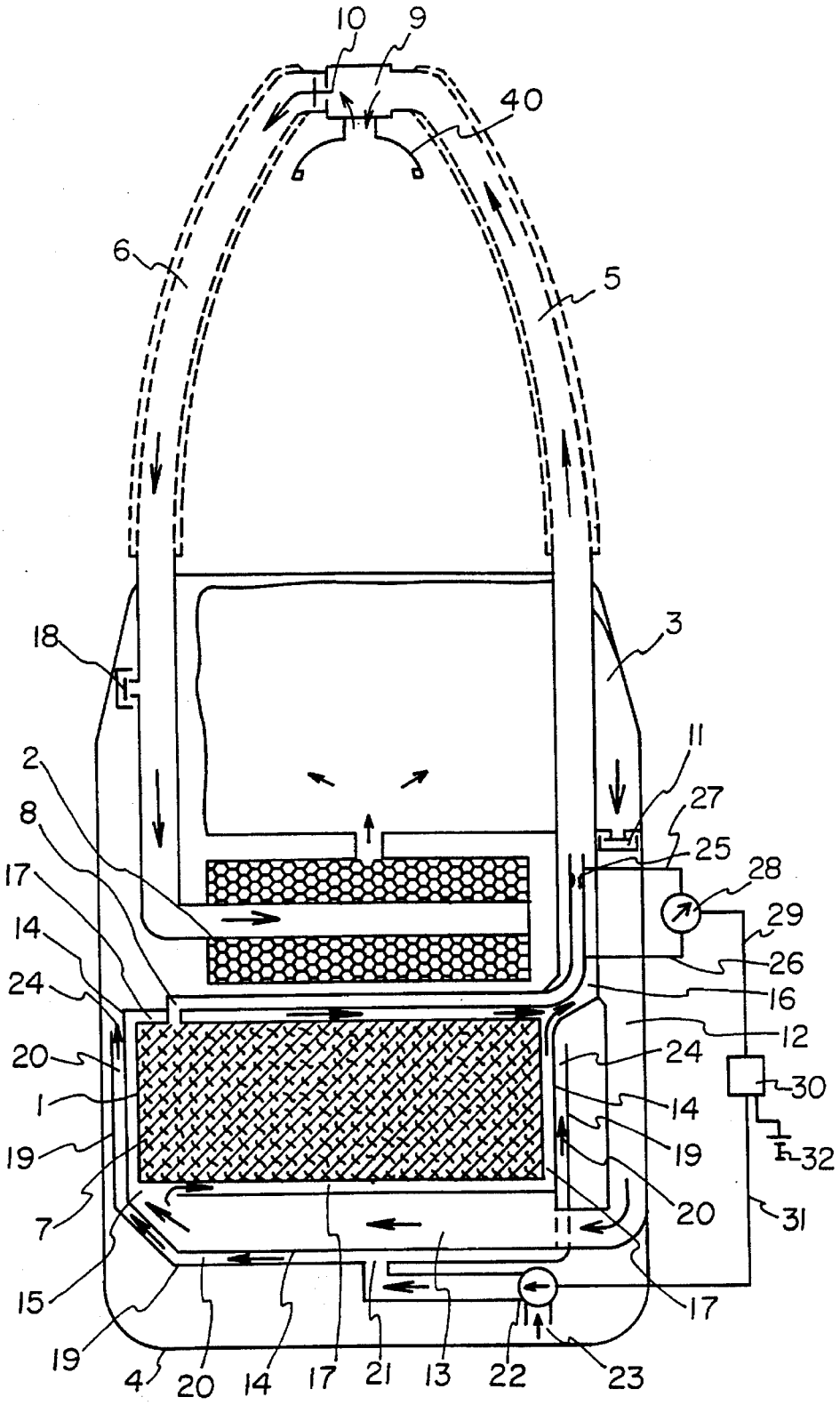
FIG. 1 is a schematic sectional view of a gas mask and breathing equipment with an air circulation duct surrounding the storage tank.

The gas mask and breathing equipment shown in FIG. 1 comprises a storage tank 1 for liquefied respiration fluid, a cartridge 2 for absorption of carbon dioxide, and a breathing bag 3. These parts are arranged in a housing 4, from which an inhalation tube 5 and an exhalation tube 6 are led out and connected to a breathing mask 40.

The said storage tank 1 contains liquefied respiration fluid 7, e.g., oxygen, adsorbed by an adsorbent material. Part of the respiration fluid evaporates (to form respiration gas) as a result of heat supply and, via a respiration gas line 8, it enters, in the gaseous state, the said inhalation tube 5, in which it mixes with the rest of the gas present in the respiration circuit. The breathing mask 40, via which the user of the device inhales the respiration gas, is connected to the said inhalation tube 5 via a connection piece 9.

During exhalation, an exhalation valve 10 arranged on the said connection piece 9 opens, and the consumed gas enters, via the said exhalation tube 6, the said cartridge 2, in which it is freed of carbon dioxide. The respiration gas thus prepared will then enter the said breathing bag 3. When the user of the device takes a breath the next time, an inhalation valve 11 at the outlet of the said breathing bag 3 opens, and the respiration gas enters, via a gas-circulating line 12, the space 13 below the said storage tank 1. The storage tank 1 is surrounded on all sides by an inner jacket wall 14, which is spaced about 1 cm from the outer side of the said storage tank 1. The inner jacket wall 14 has, at the bottom, an inlet opening 15, which communicates with the space 13 and an outlet opening 16 at the top, which communicates with the inhalation tube 5. The respiration gas passes from the said space 13 through the inner canal 17 formed between the said storage tank 1 and the said inner jacket wall 14 and into the inhalation tube 5, as a result of which the respiration circuit is closed. On its way through the said inner canal 17, the respiration gas releases heat onto the said storage tank 1, as a result of which more respiration fluid (in liquis form) will evaporate and be fed into the respiration circuit. When the respiration circuit is overfilled, part of the respiration gas escapes via a pressure relief valve 18.

The amount of respiration fluid (in liquid form) evaporated per unit of time depends on the breathing activity of the user of the device, the temperature of the respiration gas and the ambient temperature, and the amount of liquefied respiration fluid present in the said storage tank 1. A constant amount of evaporated respiration fluid (respiration gas), adjusted to the maximum demand of the user of the device, is desirable for many applications.

To achieve this constancy, the inner jacket wall 14 is surrounded at the bottom and on the sides by an external jacket wall 19, so that an outer canal 20, acting as an air circulation duct, is formed. The air circulation duct 20 has, at the bottom, an opening 21, to which a fan 22 is connected, which draws in ambient air via a connection piece 23 and blows it into the said air circulation duct 20. The air escapes via upper openings 24 of the said air circulation duct 20.

A throttle valve 25 is arranged in the said respiration gas line 8. A differential pressure sensor 28 is connected in front of and behind the said throttle 25 via measuring lines 26, 27.

The said differential pressure sensor 28 generates a control signal, which depends on the amount of respiration fluid (in liquid form) evaporated per unit of time and is sent to a control unit 30 via a signal line 29. The control unit 30 controls the delivery capacity of the said fan 22 via a control line 31 and consequently the amount of heat fed into the said storage tank 1 such that the amount of respiration fluid (in liquid form) evaporated will be maintained at a predeterminable set value.

A battery 32 supplies the said control unit 30 and the said fan 22 with electrical energy.

In the embodiment of the present invention described above and represented in FIG. 1, the heat transfer between the ambient air and the liquefied respiration fluid (in liquid form) in the said storage tank 1 takes place via the respiration fluid (in liquid form) flowing in the said inner canal 17.

Figure 2:
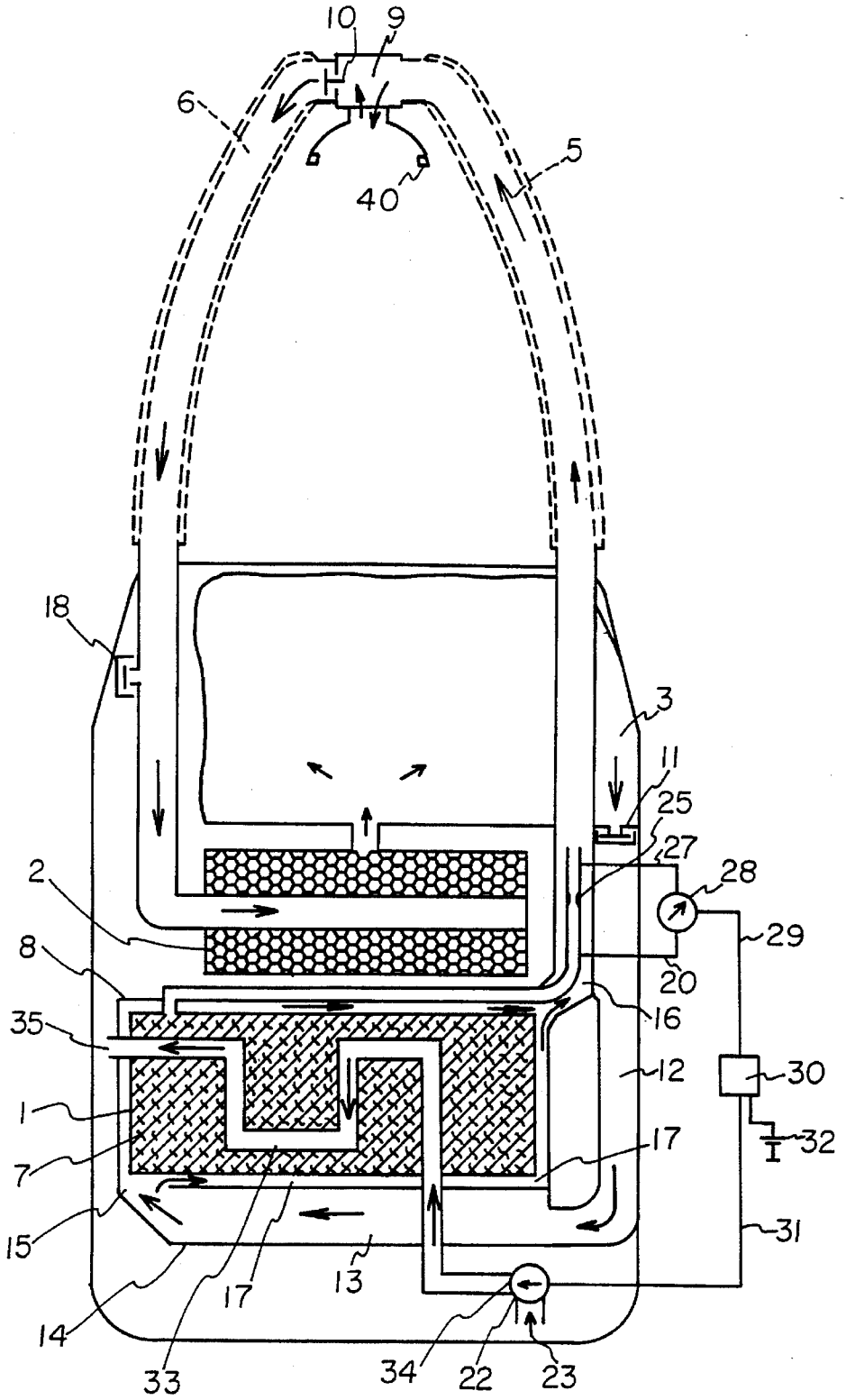
FIG. 2 is a schematic sectional view of a gas mask and breathing equipment with tubes for circulating air within the storage tank.

In contrast to this, the embodiment of the present invention shown in FIG. 2 permits direct heat transfer. To achieve this, a meandering air circulation duct 33 is arranged within the storage tank 1. The circulation duct 33 extends from a lower end 34 of which the fan 22 delivers ambient air, which leaves the air circulation duct 33 at its top end 35 that is open to the environment. The outer jacket wall 19, and consequently the outer canal 20 (FIG. 1) as well, are eliminated in this embodiment. Due to direct heat transfer, the thermal inertia of the control unit is substantially lower than in the embodiment shown in FIG. 1. The mode of operation of the said gas mask and breathing equipment according to FIG. 2 is the same as that described in connection with FIG. 1.

While specific embodiments of the invention have been shown and described in detail to illustrate the application of the principles of the invention, it will be understood that the invention may be embodied otherwise without departing from such principles.

What is claimed is:

1. A gas mask and breathing equipment arrangement, comprising:

a breathing loop having an exhalation tube, a carbon dioxide scrubber, a breathing bag, a storage tank for storing liquified respiration fluid, and an inhalation tube, wherein exhaled gas enters said exhalation tube, passes through said carbon dioxide scrubber and then passes to said breathing bag;

air circulation duct means including an air circulation duct having an intake for ambient air and a discharge, said circulation duct maintaining ambient air separate from said storage tank, said circulation duct being disposed adjacent to said storage tank for transferring heat of evaporation from ambient air in said circulation duct to said liquified respiration fluid;

a fan delivering ambient air through said air circulation duct;

a control unit means connected to said fan for controlling the air delivery capacity of said fan and the amount of heat supplied to said storage tank, and thereby controlling the amount of respiration fluid evaporated; and a sensor means positioned adjacent to an output of said storage tank for sensing an amount of respiration fluid evaporated per unit time, said sensor means being connected to said control unit and supplying a control signal based on said amount of sensed evaporated fluid, said control signal adjusting the air delivery capacity of said fan and thereby controlling the amount of respiration gas evaporated per unit time to a predeterminable value.

2. A gas mask and breathing equipment arrangement according to claim 1, wherein:

said sensor is a differential pressure sensor determining pressure drop over a throttle arranged in a respiration fluid line carrying said evaporated respiration fluid thereby providing a measurement of volume rate of flow of said evaporated respiration fluid.

3. A gas mask and breathing equipment arrangement according to claim 1, wherein:

said air circulation duct is formed as an intermediate space between an inner jacket wall surrounding said storage tank and an outer jacket wall surrounding said inner jacket wall.

4. A gas mask and breathing equipment arrangement according to claim 1, wherein:

said air circulation duct comprises one of an air circulation duct and a plurality of air circulation ducts passing through said storage tank.

5. A breathing apparatus comprising: a breathing loop having an exhalation tube, a carbon dioxide scrubber, a breathing bag, a storage tank with a source of liquefied oxygen, and an inhalation tube, wherein exhaled gas enters said exhalation tube, passes through said carbon dioxide scrubber and then to said breathing bag;

means for generating a constant amount of oxygen for inhalation comprising a heating arrangement and a differential pressure sensor, said heating arrangement comprising an ambient air inlet, a fan, a motor controlled by said differential pressure sensor that drives said fan, a heat exchange conduit, and an ambient air outlet, wherein ambient air is drawn in to said heat exchange conduit by said fan in response to said differential pressure sensor, said heat exchange conduit extending into contact with said source of liquefied oxygen and causing evaporation of the same and then exiting said breathing apparatus via said ambient air outlet, whereby ambient air is not inhaled, the evaporated oxygen flowing and mixing with gas from said breathing bag to said inhalation conduit for inhalation; the rate of evaporation of said liquefied oxygen being sensed and controlled by said differential pressure sensor.

* * * * *